United States Patent [19]

Przybylinski

[11] Patent Number: 4,590,864

[45] Date of Patent: May 27, 1986

[54] SINGLE AXLE TRUCK SUSPENSION FOR RAILWAY FLAT CAR

[75] Inventor: Phillip G. Przybylinski, Schererville, Ind.

[73] Assignee: Pullman Standard Inc., Chicago, Ill.

[21] Appl. No.: 553,253

[22] Filed: Nov. 18, 1983

[51] Int. Cl.[4] ..... B61F 5/00

[52] U.S. Cl. ..... 105/199 S; 105/200

[58] Field of Search ..... 105/199 S, 200, 224 R, 105/226, 169; 29/401.1; 228/170, 173 F, 182

[56] References Cited

U.S. PATENT DOCUMENTS 2,941,482 6/1960 Furrer ..... 105/169

2,976,821 3/1961 Wulff et al. ..... 105/226 X

FOREIGN PATENT DOCUMENTS 2741252 3/1979 Fed. Rep. of Germany ... 105/199 S 1310609 10/1962 France ..... 105/224 R

*Primary Examiner*—Harry Tanner

*Attorney, Agent, or Firm*—Richard J. Myers & Assoc.

[57] ABSTRACT

A railway flat car is supported on an underframe which includes suspension support frames provided with single axle suspensions. The frames include longitudinally spaced bolsters including horizontal frame structures on which leaf springs are supported which are also carried by journals supporting the single axles. The ends of the leaf springs are supported by vertical spaced hanger straps pivotally connected at their lower ends to support brackets which are fixed to the bolster structures of the support frames. In the present improvement the brackets are welded into recesses provided in the bolsters providing an improved structure minimizing stress problems. The brackets become an integral part of the bolster structures.

14 Claims, 8 Drawing Figures

SINGLE AXLE TRUCK SUSPENSION FOR RAILWAY FLAT CAR

BACKGROUND OF THE INVENTION

1. Field of Invention

The present invention is in the field of railway flat cars. More specifically the invention resides in railway flat cars having single axle suspensions which provide a relatively strong and light structure.

2. Description of the Prior Art

The prior art includes patents which relate to relatively light structures supported on single axle suspensions, this structure being particularly common in the British rail designs. In these the longitudinal center sill is the backbone of the car which is provided with longitudinally spaced transverse bolsters providing essentially the truck frames at the opposite ends of the sill. Horizontal and vertical brackets interconnected to the bolsters provide structure which supports and guides the axle journals and single axle combination. Leaf springs are employed in this design and are supported in vertical spring hangers which are pivotally connected at their lower ends to brackets which in the prior art British design, are attached by means of bolts to the bottom of the bolster structures. The present invention lies in the improved connection of the brackets to the bolster structures.

SUMMARY OF THE INVENTION

The present invention lies in the improved railway flat car structure over the British design of the intermodal flat car which includes the longitudinal center sill as the backbone of the car with the bolster beams and associated structure forming truck frames connected to opposite ends of the center sill. The British rail design includes single axle suspension and the design is restricted in height which necessitates certain limitations in the trailer deck height and suspension height. In the prior art British design, the pivot support brackets for the suspension are connected by means of bolts to the underneath surfaces of the bolsters. These brackets in the present improved design are now however recessed into the tubular bolsters and effectively welded thereon solving problems of the reduced height necessitated by the shortcomings in height of the British design as well as achieving other improvements enumerated hereinbelow.

DESCRIPTION OF THE PREFERRED EMBODIMENT

Figure 1:
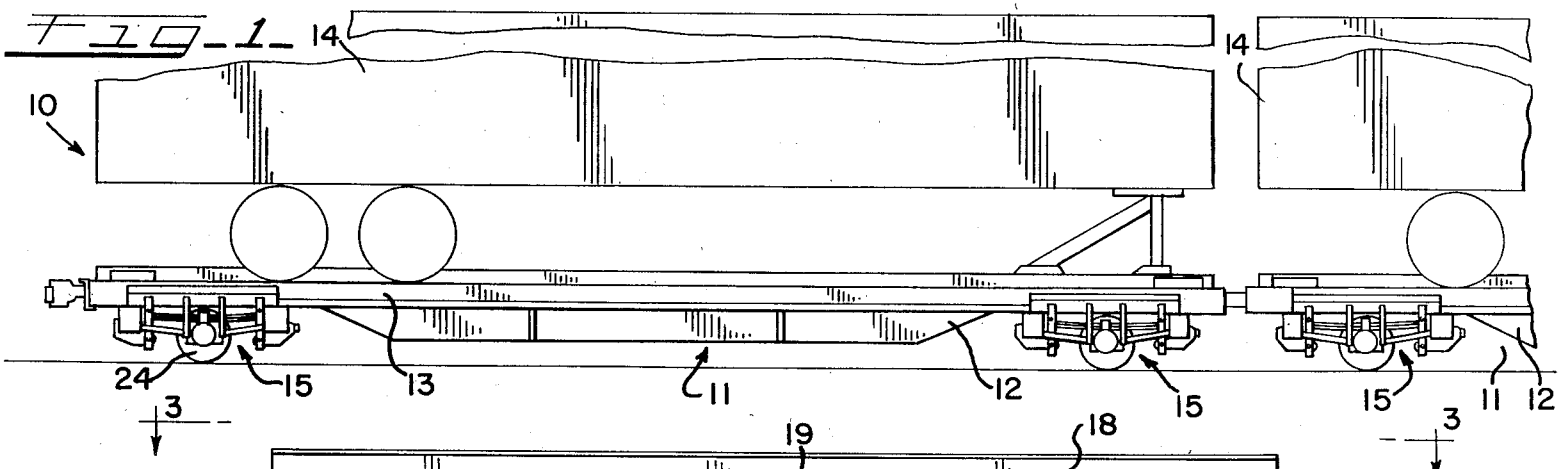
FIG. 1 is a side elevational view of a railway flat car train supported on an improved single axle suspension arrangement.

FIG. 1 discloses a two car train 10 of flat cars 11 which include underframes 12 and center sill structures 13. A load, such as highway cargo trailer 14, may be carried by each of the cars 11. The cars 11 are supported on single axle wheel trucks generally designated 15.

Figure 2:
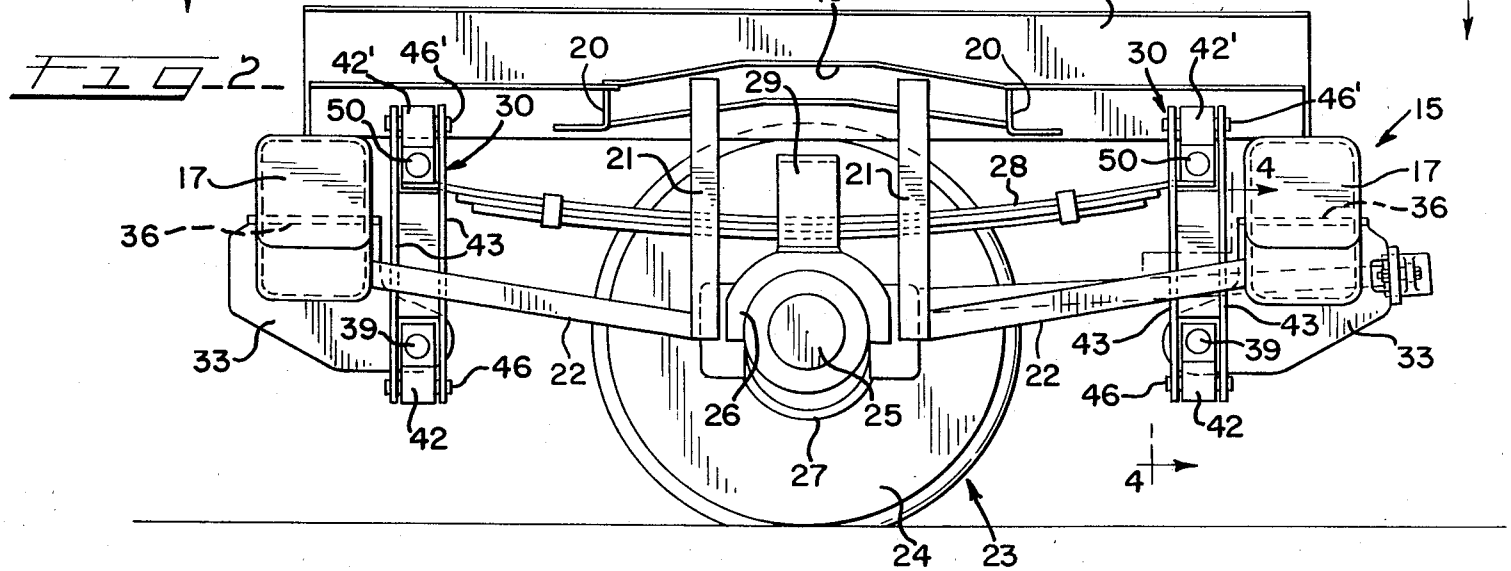
FIG. 2 is a side elevational view of a single axle truck frame and associated structure which in assembly is connected to the center sill underframe of the railway car.
Figure 3:
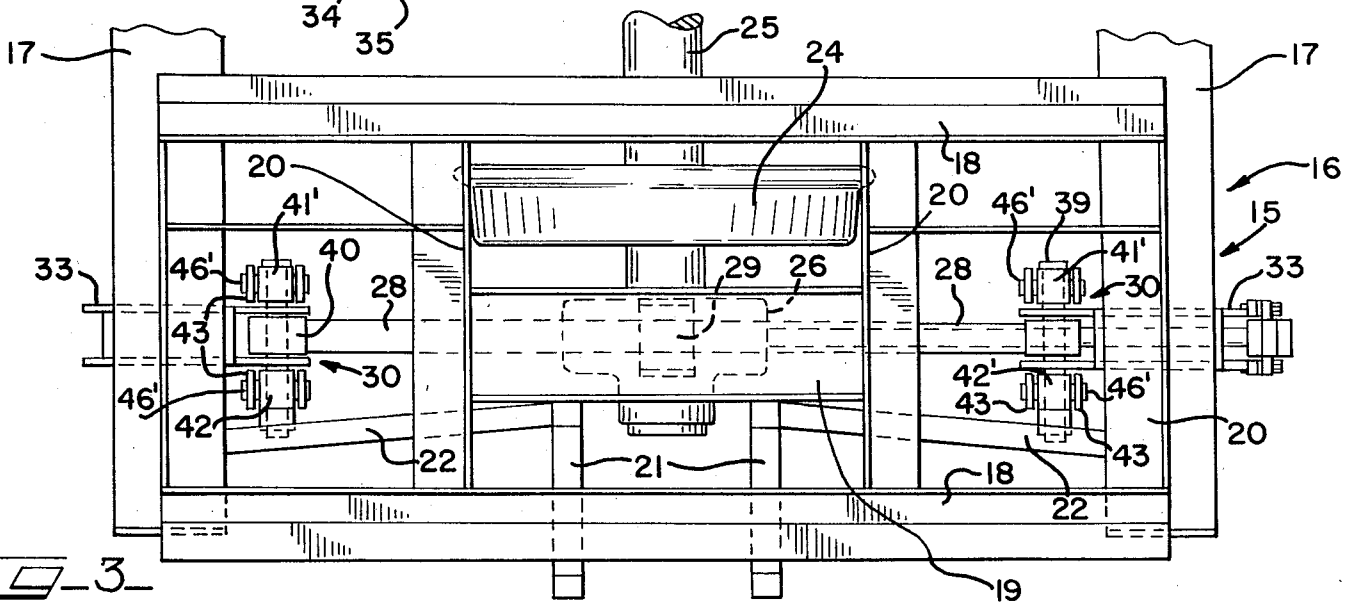
FIG. 3 is a plan view of the truck disclosed in FIG. 2.

Referring to FIGS. 2 and 3, each wheel truck 15 rollingly supports a portion of the car by structure which includes transversely extrending bolsters 17 which extend across and are suitably connected to the center sill underframe in conventional fashion. Each suspension support structure includes inner and outer horizontal channel members 18 and channel frame member 19 which are interconnected by transverse frame members 20. The ends of the frame members 18 are rigidly secured to the transverse bolster members 17.

The outer channel frame members 18 and frame member 19 also have connected thereto vertically inclined brackets 21 which at their lower ends have connected thereto diagonally extending brackets 22 which are rigidly secured to the bolster members 17. A single axle and wheel combination 23 includes a conventional pair of railway car wheels 24 secured to a standard axle 25. The axle is journalled in a journal housing 26 having a lower stop 27. A leaf spring assembly 28 is retained in a guide retainer 29. The opposite ends of the leaf spring assembly 28 are supported on hanger straps generally designated at 30.

Figure 5:
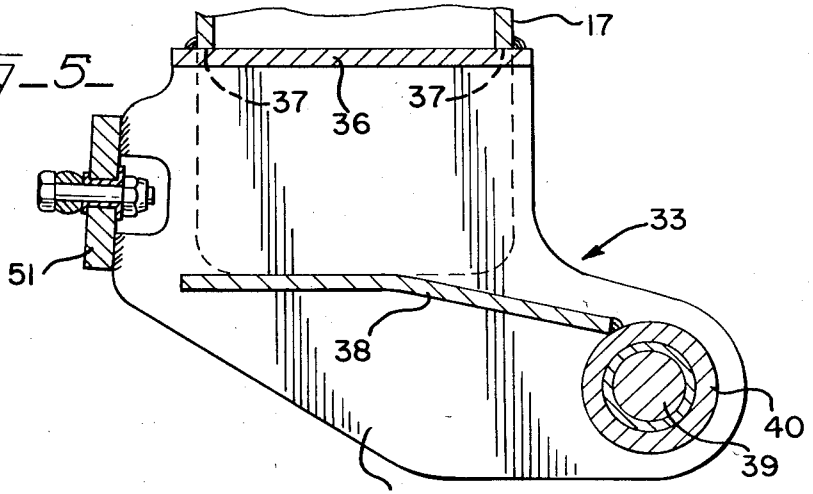
FIG. 5 is a cross sectional view taken along the line 5—5 of FIG. 4.
Figure 6:
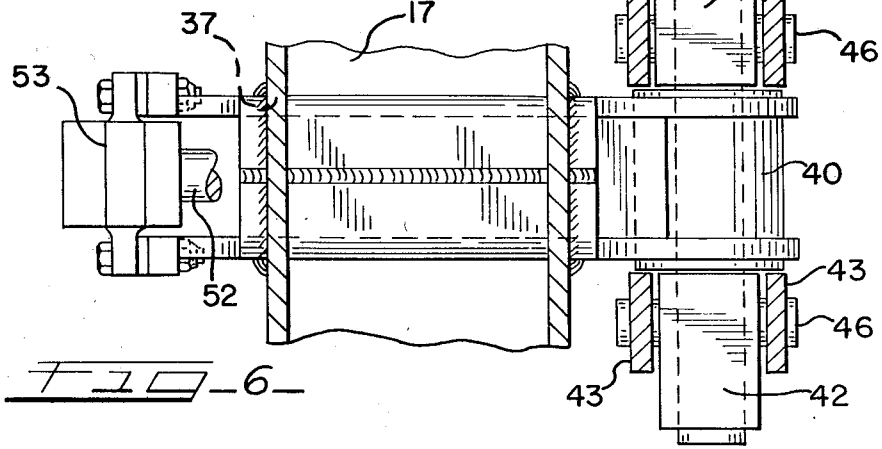
FIG. 6 is a cross sectional view taken along the line 6—6 of FIG. 4.
Figure 4:
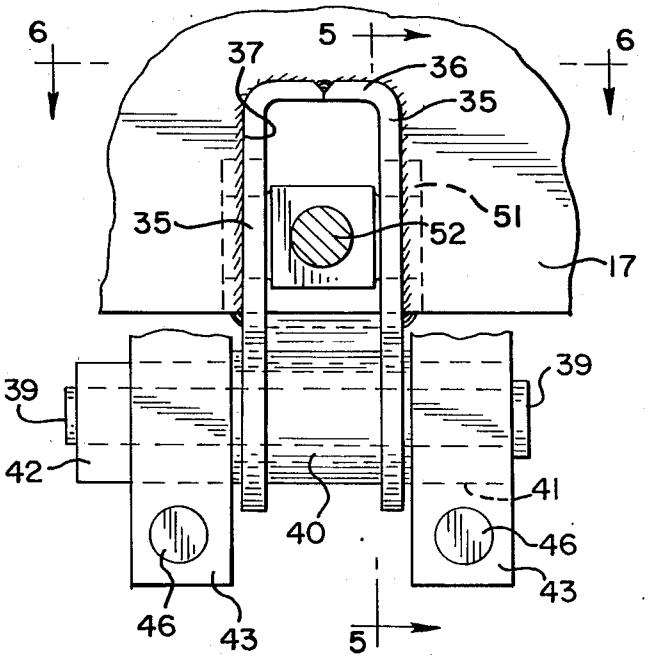
FIG. 4 is a cross sectional view taken along the line 4—4 of FIG. 2.

The hanger strap assembly is supported from the bolsters 17 by virtue of brackets 33. The brackets 33, as best shown in FIGS. 4, 5 and 6, each comprise a U-shaped body 34 having spaced vertical body or vertical plate portions 35 connected by an integral top wall 36. The bolster supports the brackets which are welded into recesses 37 in the bolster 17. A transverse rigidifying gusset or transverse plate 38 is suitably welded to the plate portions 35. The plates 35 project downwardly below the bolsters 17 and support a transverse rod or pin 39 which extends through a sleeve 40 which is secured to and extends through both plates 35. A pair of outer bushing blocks or sleeves 41 and 42 are supported on the pin 39 for swivelling movement. Vertical straps 43 project vertically upwardly from the bushing blocks 41 and 42 which are pivotally supported on the brackets 33. The blocks 41 and 42 project downwardly between the straps 43 and are secured to the lower ends of the straps by pivot pins 46 which also extend through the lower ends of the blocks which are apertured in transverse relation with respect to the extension of the pin 39. The straps 43 project upwardly and support the ends of the leaf spring assembly 28. At their upper ends the straps are provided with similar bushing blocks 41' and 42' which also extend below the pivot pins 46' and provide a seat for the ends of the spring assembly 28. A bushing 50 secures the upper ends of straps 43 to the spring assembly 28.

As best shown in FIGS. 4, 5, and 6 a stabilizer plate 51 is welded to the rearmost end of the plates 35 and a stabilizer rod 52 is secured to a stabilizer securing assembly generally designated at 53. The assembly 53 is not further described since it does not form an essential part of the present invention.

Figure 7:
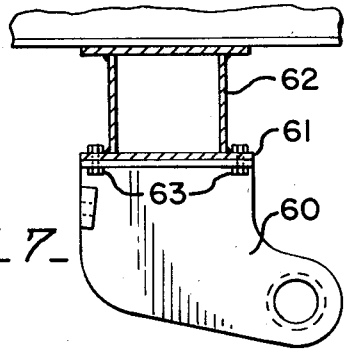
FIG. 7 PRIOR ART
FIG. 7 is a cross sectional view of the prior art bracket and connection of British Rail design.
Figure 8:
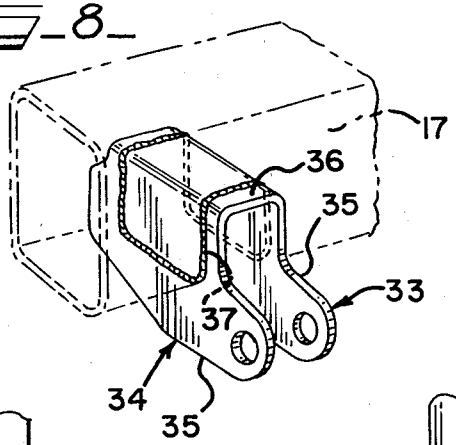
FIG. 8 discloses the improved bracket and connection thereof of the improved design.

FIG. 7 discloses the prior art. The present improvement lies in the bracket 34 which is recessed into the bolster and securely welded therein. The prior art bracket 60 is disclosed as being secured to the lower flange 61 of a bolster 62 by means of bolts and nuts 63.

The prior art has many shortcomings. These are as follows. At the precise point of attachment, for reasons of the problems of limited height, the bolster must be limited in height. Further spring loads acted off the center of the bolster beam creates movement to be carried by the attachment bolts. Thus combined moments and forces cause local fatigue problems in the immediate bolster area which would necessitate substantial local reinforcement. The improved design minimizes the aforementioned problems, by providing an attachment system which becomes an integral part of the bolster structure without load concentrations to threaten the integrity of the bolster. In this design a tubular bolster is utilized which resists the moment due to off-center link forces. All forces and moments are applied more evenly to the cross section of the bolster eliminating stress and load concentrations inherent in external type of attachments. Since the bracket is welded into a slot in the bolster beam, the bolster is no longer restricted in its section height, as it would be in the prior art structure. The increased height permitted allows the use of a more efficient beam for the bolster.

The operation of the British rail design is well described in the prior art with the hangers permitting limited lateral movement with the vertical sliding flexibility of the axle and journal arrangement. Thus the design of the present British type is basically improved over the prior art bracketing arrangement of FIG. 7, by the employment of the tubular recessed weldment bracket with the many advantages it provides.

What is claimed is:

1. In a railway car suspension including a support structure adapted to be connected to the underframe of a rail car;

said truck support structure including a horizontal frame structure provided at longitudinally spaced portions with laterally extending bolster structures;

said bolster structures each comprising a pair of spaced upright walls and a top and and bottom wall connected to the upright walls;

an axle retaining structure connected to said frame structure on opposite sides thereof and projecting downwardly with respect thereto;

a leaf spring assembly including a pair of laterally spaced leaf springs positioned inwardly of and adjacent to said axle retaining structure;

an axle and wheel assembly including spaced axle journals positioned to be engageable with said axle retaining structure for limited movement with respect thereto;

said leaf spring assembly having intermediate portions thereof supported on said axle journals;

hanger strap assemblies supporting opposite ends of said leaf spring assembly and projecting downwardly therefrom;

said hanger strap assemblies having limited sideways movement;

the improvement of a support bracket for each hanger strap assembly;

said support brackets each including a lower pivot portion pivotally connected to lower portions of said hanger strap assemblies;

said bolster structure upright walls having openings therein;

and said support brackets each including a body portion extending through said openings and within said bolster structures, and being rigidly secured in said openings and within said bolster structures to allow clearance of the support brackets from the rails when a deep bolster structure is used with a low level underframe in the railway car.

2. The improvement in accordance with claim 1, said bolster structure bottom wall having an aperture therein forming in combination with said upright wall openings a recess in said bolster structure, said bracket having an inverted U-shaped configuration, said U-shaped configuration portion being secured within said recess.

3. The improvement in accordance with claim 2, said bracket having portions thereof projecting below said bolster structure and portions of said bracket projecting outwardly o opposite sides and below said bolster structure;

said U-shaped configuration portion being rigidly attached to said upright walls and bottom walls of said bolster structure for distributing the load received from the bracket in the bolster structure.

4. The improvement in accordance with claim 3, including stabilizer means connected to said bracket and port thereof extending within said recess of sa bolster structure.

5. The improvement in accordance with claim 4, said bolster structures having a box-like hollow configuration.

6. The improvement in accordance with claim 4, said bolster having a rear portion projecting outwardly from said bolster recess, and said stabilizer means including a rod connected to said rear portion.

7. The improvement in accordance with claim 6, said rod projecting outwardly of said recess and being connected to said axle journals.

8. The improvement in accordance with claim 2, said bracket having a rear portion projecting outwardly from said recess, and stabilizer rod means connected to said rear portion and extending through said recess, and means connecting said rod to said axle journal.

9. The improvement in accordance with claim 1, said bracket including upright laterally spaced sidewalls, and a connecting horizontal upper wall.

10. The improvement in accordance with claim 9, bracket including a second horizontal wall connect said sidewalls for reinforcing the bracket, and means on said brackets supporting said hanger strap assemblies.

11. In a railway car suspension including a support structure adapted to be connected to the underframe of a railway car;

said truck support structure including a horizontal frame structure provided at longitudinally spaced portions with laterally extending bolster structures;

said bolster structures each comprising a pair of spaced upright walls and a top and and bottom wall connected to the upright walls;

an axle retaining structure connected to said frame structure on opposite sides thereof and projecting downwardly with respect thereto;

a leaf spring assembly including a pair of laterally spaced leaf springs positioned inwardly of and adjacent to said axle retaining structure;

an axle and wheel assembly including spaced axle journals positioned to be engageable with said axle retaining structure for limited movement with respect thereto;

said leaf spring assembly having intermediate portions thereof supported on said axle journals;

hanger strap assemblies supporting opposite ends of said leaf spring assembly and projecting downwardly therefrom;

said hanger strap assemblies having limited sideways movement;

the improvement of a support bracket for each hanger strap assembly;

said support brackets each including a lower pivot portion pivotally connected to lower portions of said hanger strap ssemblies;

said bolster structures each having an opening therein;

said support brackets each having a body portion extending through one of said openings in one of said bolster structures and extending into said bolster structure to allow clearance of the support brackets from the rails when a deep bolster structure is used with a low level underframe in the railway car; and said body portion being rigidly attached to said upright walls and bottom wall of said bolster structures for distributing the load received from the bracket in the bolster structure.

12. The invention according to claim 11 and said body portion of said bracket including a pair of spaced side walls connected by a top wall.

13. The invention according to claim 12 and said body portion including an intermediate reinforcing wall connecting the side walls for rigidifying the bracket.

14. The invention according to claim 13 and said side walls and top wall of said bracket being welded to said bolster structure.

* * * * *